US007074044B2

(12) United States Patent
Billing et al.

(10) Patent No.: US 7,074,044 B2
(45) Date of Patent: Jul. 11, 2006

(54) ROTATING CONNECTION

(75) Inventors: Heinz Billing, Haunetal/Wehrda (DE); Erich Beer, Huenfeld (DE)

(73) Assignee: WELLA AG, Darmstadt (DE)

( * ) Notice: Subject to any disclaimer, the term of this patent is extended or adjusted under 35 U.S.C. 154(b) by 0 days.

(21) Appl. No.: 10/507,998

(22) PCT Filed: Apr. 12, 2003

(86) PCT No.: PCT/EP03/03812

§ 371 (c)(1),
(2), (4) Date: Sep. 16, 2004

(87) PCT Pub. No.: WO03/092127

PCT Pub. Date: Nov. 6, 2003

(65) Prior Publication Data

US 2005/0142899 A1 Jun. 30, 2005

(30) Foreign Application Priority Data

Apr. 26, 2002 (DE) ..... 102 18 694

(51) Int. Cl.
*H01R 39/00* (2006.01)

(52) U.S. Cl. ..... 439/23

(58) Field of Classification Search ..... 439/23, 439/21, 24, 26, 25, 669
See application file for complete search history.

(56) References Cited

U.S. PATENT DOCUMENTS 2,453,073 A * 11/1948 Jones ..... 439/26
3,860,312 A 1/1975 Gordon, Jr.
5,147,221 A * 9/1992 Cull et al. ..... 439/585
5,409,403 A 4/1995 Falossi et al.

FOREIGN PATENT DOCUMENTS

DE 3918 234 A1 12/1990

* cited by examiner

*Primary Examiner*—Phuong Dinh
(74) *Attorney, Agent, or Firm*—Michael J. Striker

(57) ABSTRACT

An electrical swivel coupling (1) with one inner and one outer wiper contact ring arrangement (2, 3) for transmitting electric currents; the inner wiper contact ring arrangement (2) is provided with first wiper rings (4), which have first lugs (7) leading outward to one side, and each first wiper ring g (4) is in one piece with a first lug (7). The outer wiper contact ring arrangement (3) has second wiper rings (5), which have second lugs (8) leading outward to an opposite side, and each second wiper ring is in one piece with a second lug (8). The second wiper rings (5) have spring contacts (10), which are formed by material recessing and deformation. The spring contacts (10) of the second wiper rings (5) are each in electrical contact with an outer wiper ring surface (18) of the first wiper rings (4).

10 Claims, 9 Drawing Sheets

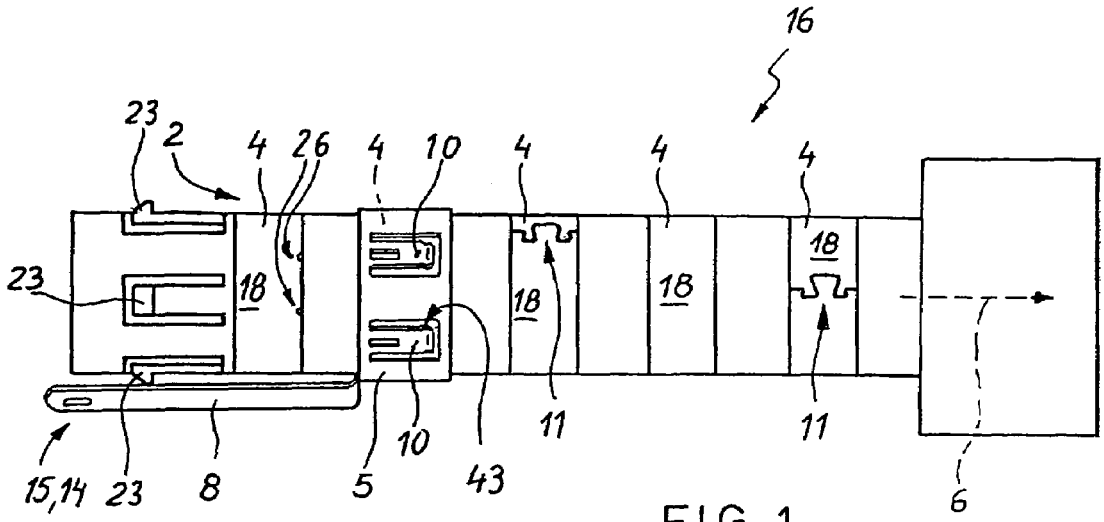
FIG. 1
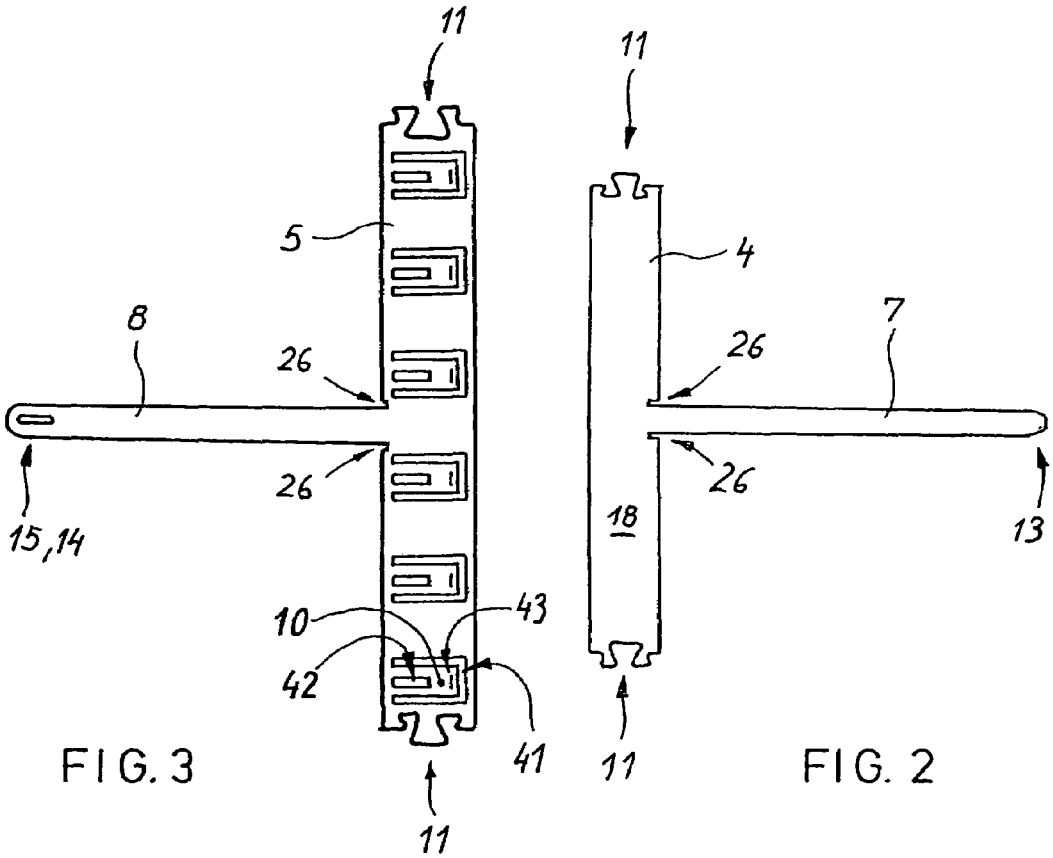
FIG. 3
FIG. 2

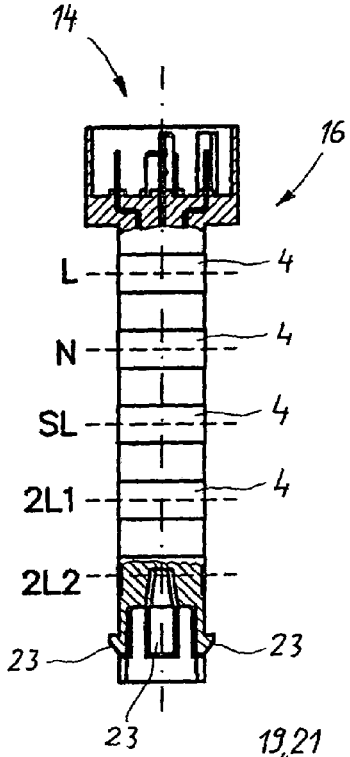
FIG. 8
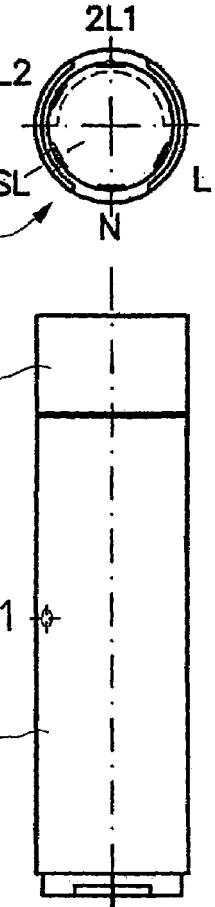
FIG. 12
FIG. 11
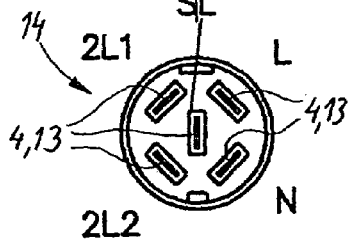
FIG. 13
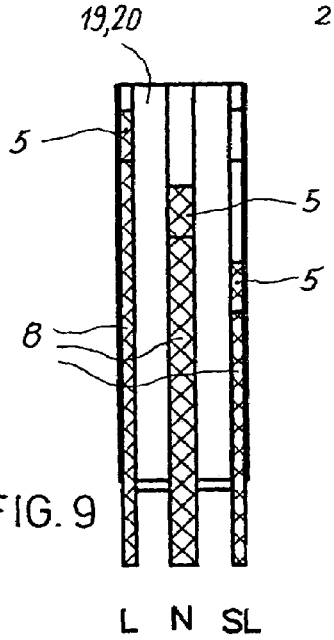
FIG. 9
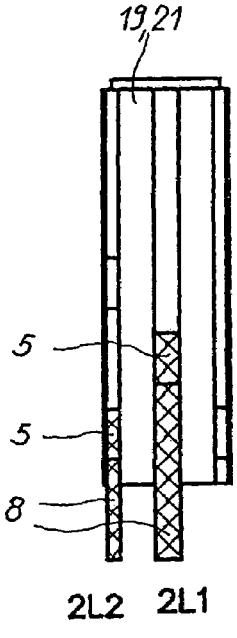
FIG. 10

ROTATING CONNECTION

BACKGROUND OF THE INVENTION

The invention relates to an electrical swivel coupling with one inner and one outer wiper contact ring arrangement for transmitting electrical currents.

Electrical swivel joint couplings are known, for instance for installation in bearings for carrier elements from which electrically driven appliances are suspended. In these couplings, the current of the axially successive contact rings in the rotor is carried to the outside with the aid of solidly-soldered connection cables. These contact rings are tapped by metal bands with cut-in, outward-curved contact ribs, as known for instance from German Patent Disclosure DE 39 18 234 A1.

SUMMARY OF THE INVENTION

The object of the invention is to create a coupling of this generic type which is simpler and more compact in construction and less expensive to produce yet has very good electrical properties.

This object is attained in accordance with the invention by an electrical swivel coupling, which comprises an inner wiper contact ring arrangement and an outer wiper ring arrangement for transmitting electrical current:

wherein the inner wiper contact ring arrangement comprises a plurality of first wiper rings which have respective first lugs leading outward to one side in an axial direction and the outer wiper contact ring arrangement comprises a plurality of second wiper rings, which have respective second lugs leading outward to an opposite side in another axial direction opposite from the axial direction, the second wiper rings being provided with a plurality of spring contacts formed by recesses and deformations provided in the second wiper rings, so that the spring contacts of the second wiper rings are in electrical contact with an outer wiper ring surface of the first wiper rings arranged coaxially in relation to the second wiper rings;

wherein each first wiper ring is in one piece with an associated first lug connected therewith, each second wiper ring is in one piece with an associated second lug connected therewith, each first wiper ring and associated first lug together nave a T-shape and each second wiper ring and associated second lug together have a T-shape in developed forms prior to connecting opposite ends of wiper surfaces of the wiper rings to form the wiper rings; and wherein the first wiper rings and the second wiper rings have corresponding tongue-and-groove connections connecting opposite ends of the respective wiper ring surfaces.

Further features of the invention will become apparent from the dependent claims.

The coupling for transmitting electrical currents of the invention advantageously provides full through-rotatability of the swivel coupling and an integrated plug connection for easily undoing an electrical connection. Economical production is made possible by a simple structural design. The plug coupling comprises a rotor and a stator, for instance with up to five current paths of equal rank, with which both signal currents and power currents can be transmitted.

BRIEF DESCRIPTION OF THE DRAWING

The invention will be described in further detail in conjunction with a plurality of drawings.

Shown are:

FIG. 1, in a side view, a rotor with a plurality of first wiper rings, as part of a swivel coupling, and with an axially slipped-on second wiper ring;

FIG. 2, a developed view of a first wiper ring;

FIG. 3, a developed view of a second wiper ring;

FIG. 8, in a plan view, the rotor with fragmentary sections;

FIG. 9, in a side view, a first half-shell with second wiper rings and second lugs;

FIG. 10, in a side view, a second half-shell with second wiper rings and second lugs;

FIG. 11, in a side view, the swivel coupling;

FIG. 12, in an axial view, the soldered connection;

FIG. 13, in an axial view, the plug connection;

DETAILED DESCRIPTION OF THE INVENTION

Figure 4:
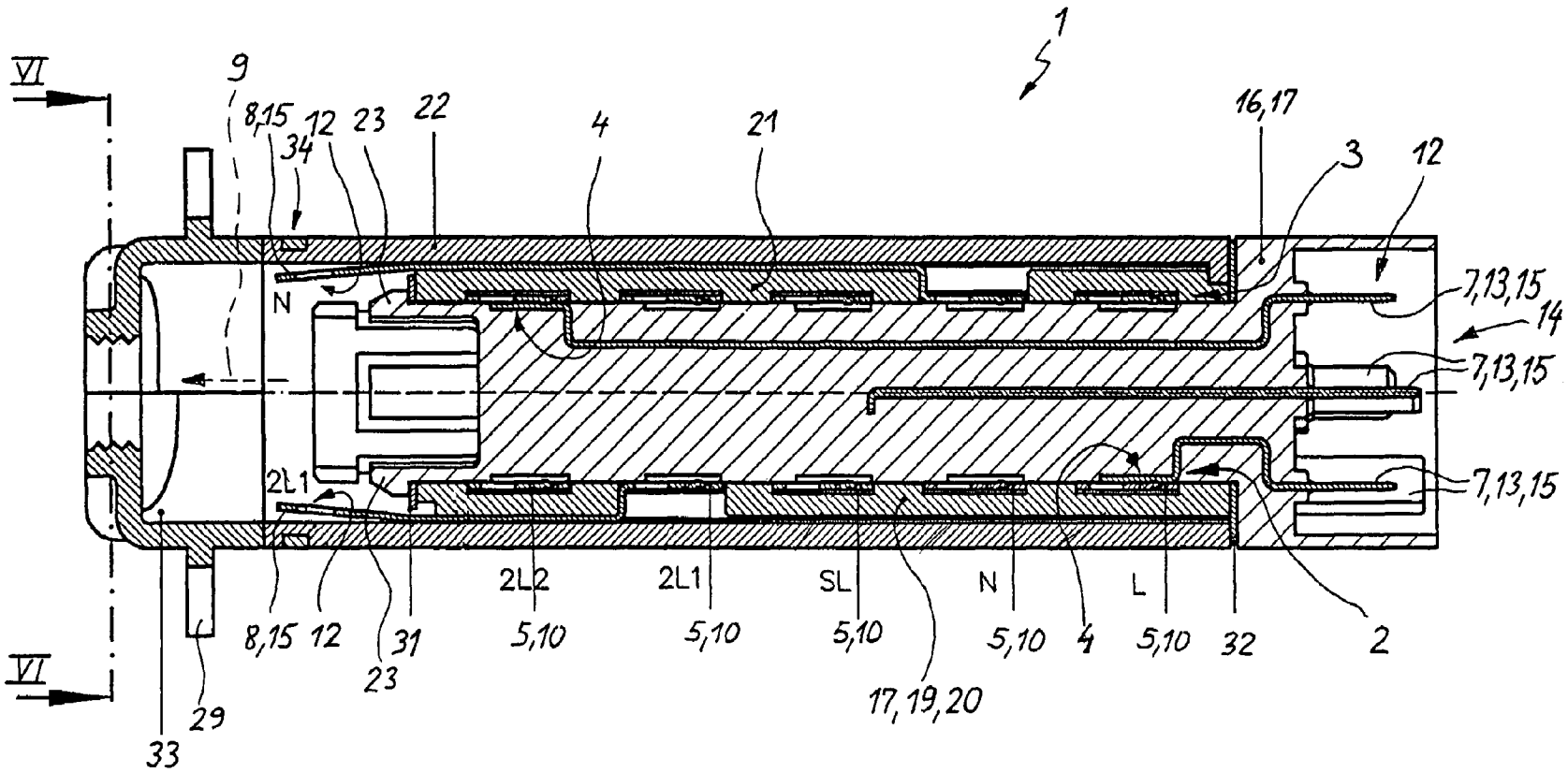
FIG. 4, in an axial section, the complete swivel coupling.

The drawings show an electrical swivel coupling 1 with one inner and one outer wiper contact ring arrangement 2, 3 for transmitting electric currents, wherein the inner wiper contact ring arrangement 2 is provided with a plurality of first wiper rings 4, which have first lugs 7 leading on one side outward in the direction 6 of the axis, and each first wiper ring 4 with a first lug 7 is of one-piece construction. The outer wiper contact ring arrangement 3 is provided with a plurality of second wiper rings 5, which have second lugs 8 leading on one side outward in an opposite direction 9 of the axis, and each second wiper ring 5 with a second lug 8 is of one-piece construction. The second wiper rings 5 are provided with a plurality of spring contacts 10, which are formed by material recessing and deformation. The spring contacts 10 of the second wiper rings 5 are each coaxially in electrical contact with an outer wiper ring surface 18 of the first wiper rings 4. The result is a simple, compact structure of the coupling 1 as well as very good electrical conductivity, since the electrical transition points (contact and soldering points) are limited to a minimum.

In FIG. 2, in a developed view, the first wiper ring 4, with a first lug 7 as an electrical conductor, is shown and is in the shape of a T. The end of the first lug 7 is designed as a contact tongue 13. Depending on the axial arrangement of the first wiper rings 4 on the rotor 16, a certain length of the first lug 7 is required so that the contact tongues 13 will come to an end for a plug connection 14 in the same plane. For bending over the first lug 7, small notches 26 are provided. The first wiper rings 4 are formed by a positive-engagement groove connection 11, and in particular by a dovetail or tongue-and-groove connection created by bending it over into a ring 4.

In FIG. 3, in a developed view, the second wiper ring 5, with a second lug 8 as an electrical conductor, is shown and is in the shape of a T. The second wiper ring 5 is provided with a plurality of identically disposed spring contacts 10. The spring contacts 10 are formed by a U-shaped recess 41, a weakening recess 42, and a deformation 43, respectively. The end of the second lug 8 is embodied for a soldered connection 15. A plug connection 14 may selectively be provided as well. Depending on the axial arrangement of the second wiper rings 5, a certain length of the second lug 8 is necessary, so that the soldered connections 15 will come to an end in the same plane. For bending over the second lug 8, small notches 26 are provided. The second wiper rings 5 are formed by a positive-engagement groove connection 11, and in particular by a dovetail or tongue and groove connection that results by bending it over into a ring 5. Selectively, the end region 12 of the first or the second lugs 7, 8 is intended as contact tongues 13 of a plug connection 14 or as a soldered connection 15.

Figures 14, 15, 16:
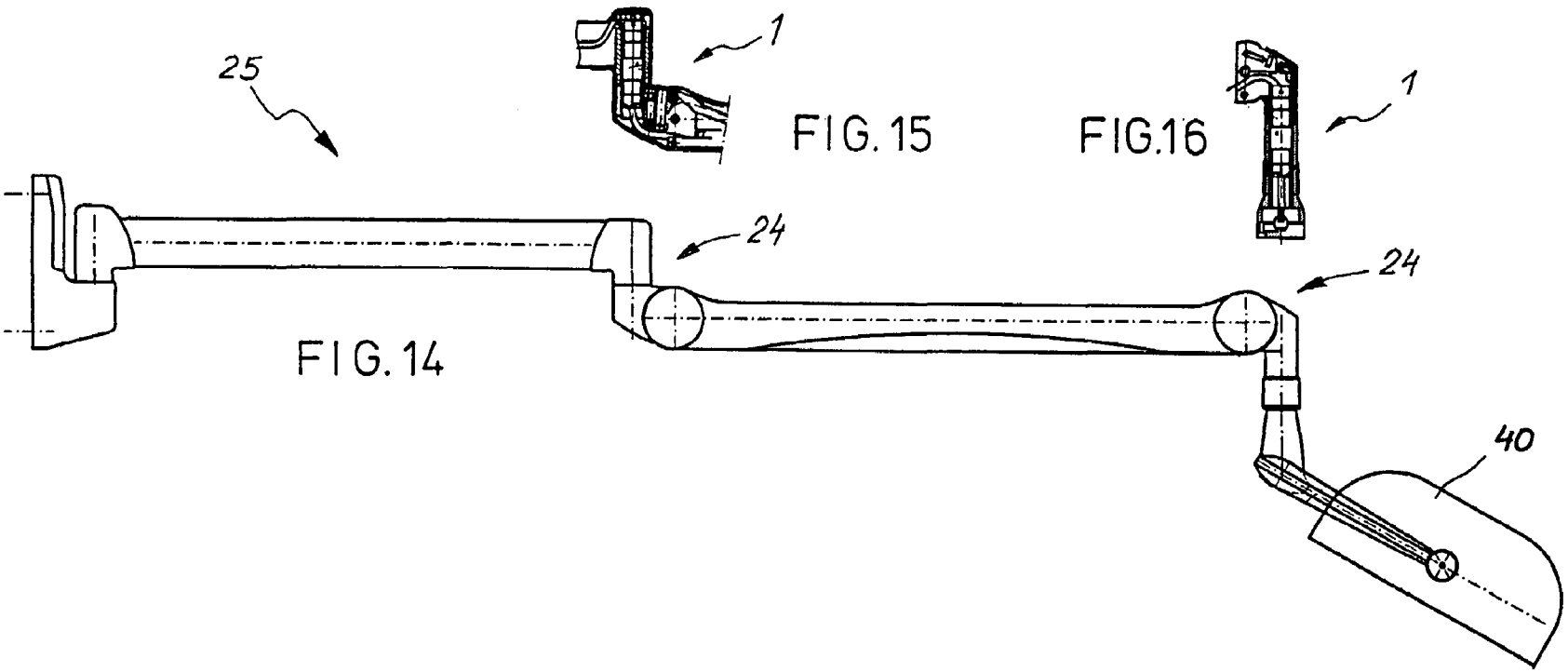
FIG. 14, in a side view, a tripod with built-in swivel couplings.
FIG. 15, in a fragmentary sectional view, a first swivel coupling.
FIG. 16, in a fragmentary sectional view, a second swivel coupling.

FIG. 4 shows the first wiper ring 4 with the first lugs 7, which are cast to make a rotor 16 of plastic 17, with the exception of the outer wiper ring surfaces 18 and the end regions 12 of the first lugs 7. The second wiper rings 5 with the second lugs 8 are received by a sleeve 19 of plastic 17. The sleeve 19 comprises two identical half-shells 20, 21 that become fixed to one another, and the sleeve 19 is received by an externally fixable housing 22. On the opposite end of the first lugs 7, the rotor 16 is provided with detent protrusions 23, which correspond with the sleeve 19 in such a way that an axial displacement of the rotor 16 is prevented; the rotor 16 is provided with a plug connection 14. The first and the second wiper rings 4, 5 are intended selectively for driving ohmic, inductive loads and video signals. For reducing friction upon rotation of the coupling 1, suitable plastic disks 31, 32 are provided. For cables, not shown here, the coupling 1 is provided with a tension relief 33, which comprises two half-shells that can be screwed on. The tension relief 33 is provided with a tab 29, for the sake of a firm connection, for instance at a swivel joint 24 of a tripod 25 (FIG. 14). For a firm connection to the housing 22, the tension relief 33 is provided with a groove connection 34.

Figure 5:
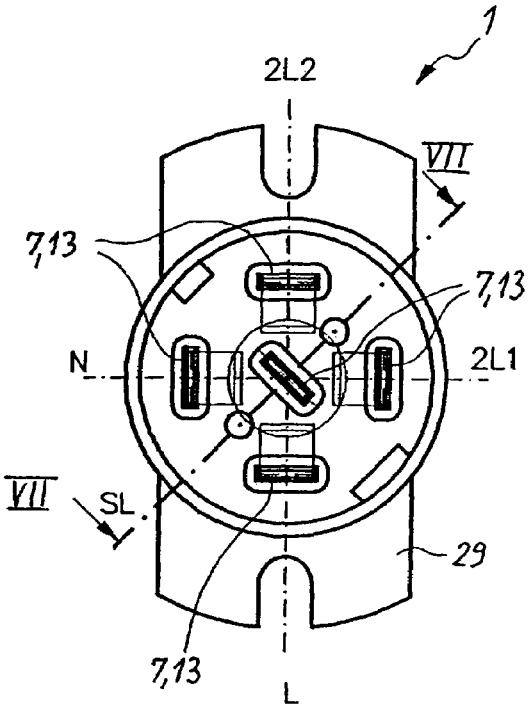
FIG. 5, in an axial section, a plug connection.

FIG. 5 shows a plug connection 14 of FIG. 4 in an axial view.

Figure 6:
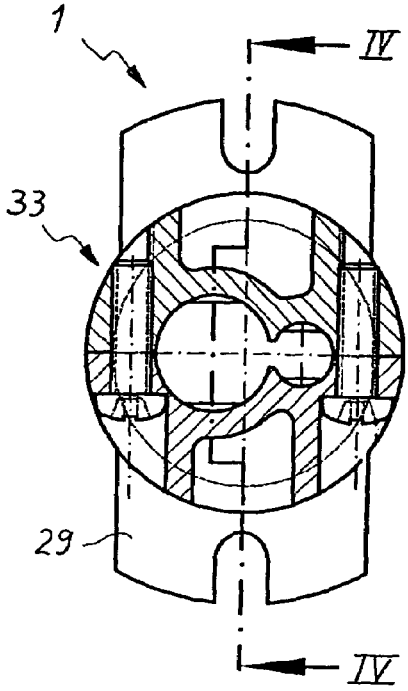
FIG. 6, a section taken along the line VI—VI of FIG. 4.

FIG. 6 shows a section VI—VI of FIG. 4, showing the tension relief 33 for cables in more detail.

Figure 7:
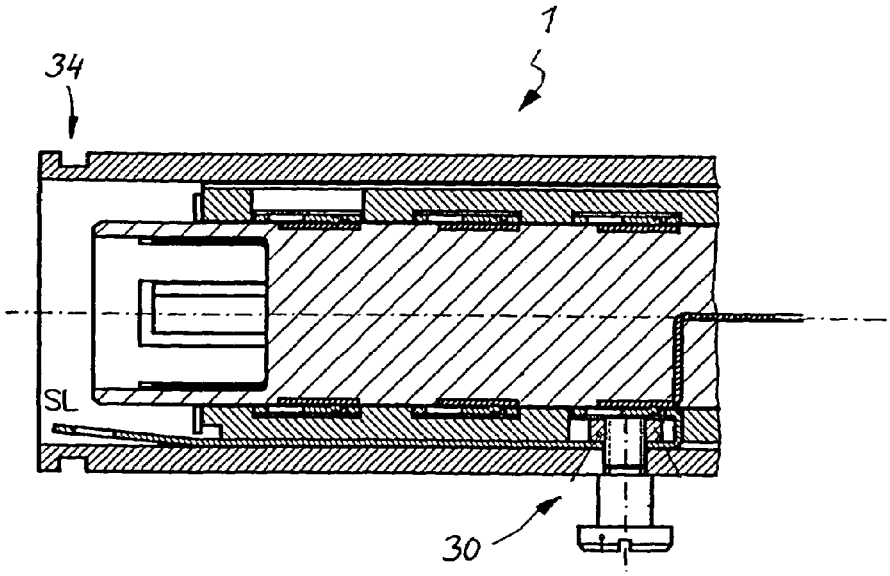
FIG. 7, a section taken along the line VII—VII of FIG. 5.

FIG. 7 shows a section VII—VII of FIG. 5, but without the tension relief 33.

FIG. 8 shows the rotor 16 with fragmentary sections in a plan view.

FIG. 9 shows a first half-shell 20 with second wiper rings 5 and second lugs 8, in a side view.

FIG. 10 shows a second half-shell 21 with second wiper rings 5 and second lugs 8, in a side view.

FIG. 11 shows the swivel coupling 1 in a side view.

FIG. 12 shows the soldered connection 15 in an axial view.

FIG. 13 shows the plug connection 14 in an axial view.

FIG. 14, as one example of an application, shows a side view of a tripod 25 with built-in swivel couplings 1, 1.1 for carrying and supplying an electrical appliance 40.

FIG. 15 shows the first swivel coupling 1 in a fragmentary sectional view.

FIG. 16 shows a second swivel coupling 1.1 in a fragmentary sectional view.

Figure 17:
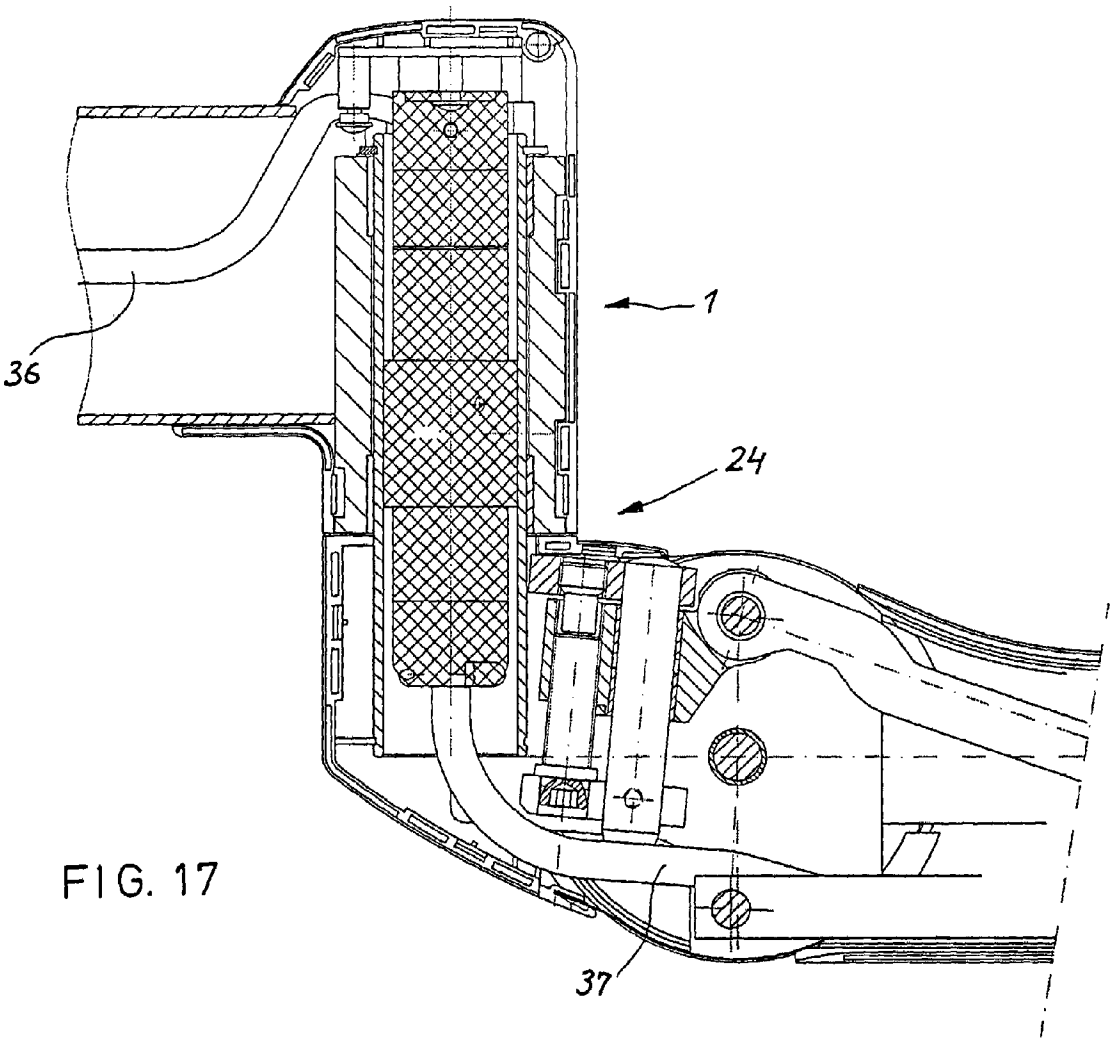
FIG. 17, in an enlarged view, the first swivel coupling of FIG. 15.

FIG. 17, in an enlarged view, shows the first swivel coupling 1 of FIG. 15, with a first and a second cable 36, 37, which are connected to the corresponding soldered connections 15 of the first and second wiper rings 4, 5.

Figure 18:
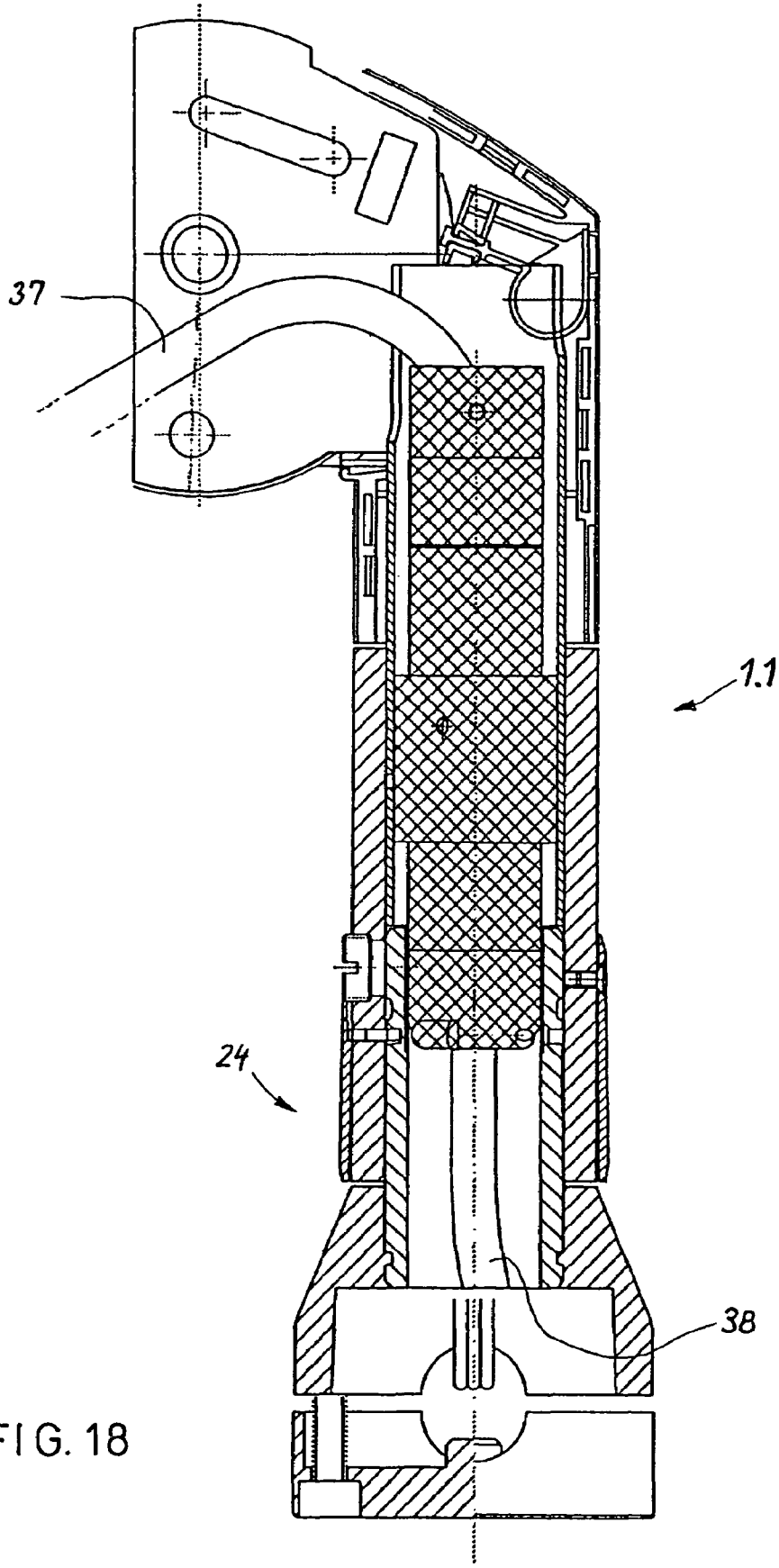
FIG. 18, in an enlarged view, the second swivel coupling of FIG. 16.

FIG. 18, in an enlarged view, shows the second swivel coupling 1.1 of FIG. 16, with the second and a third cable 37, 38, which are connected to the corresponding soldered connections 15 of the first and second wiper rings 4, 5.

Figure 19:
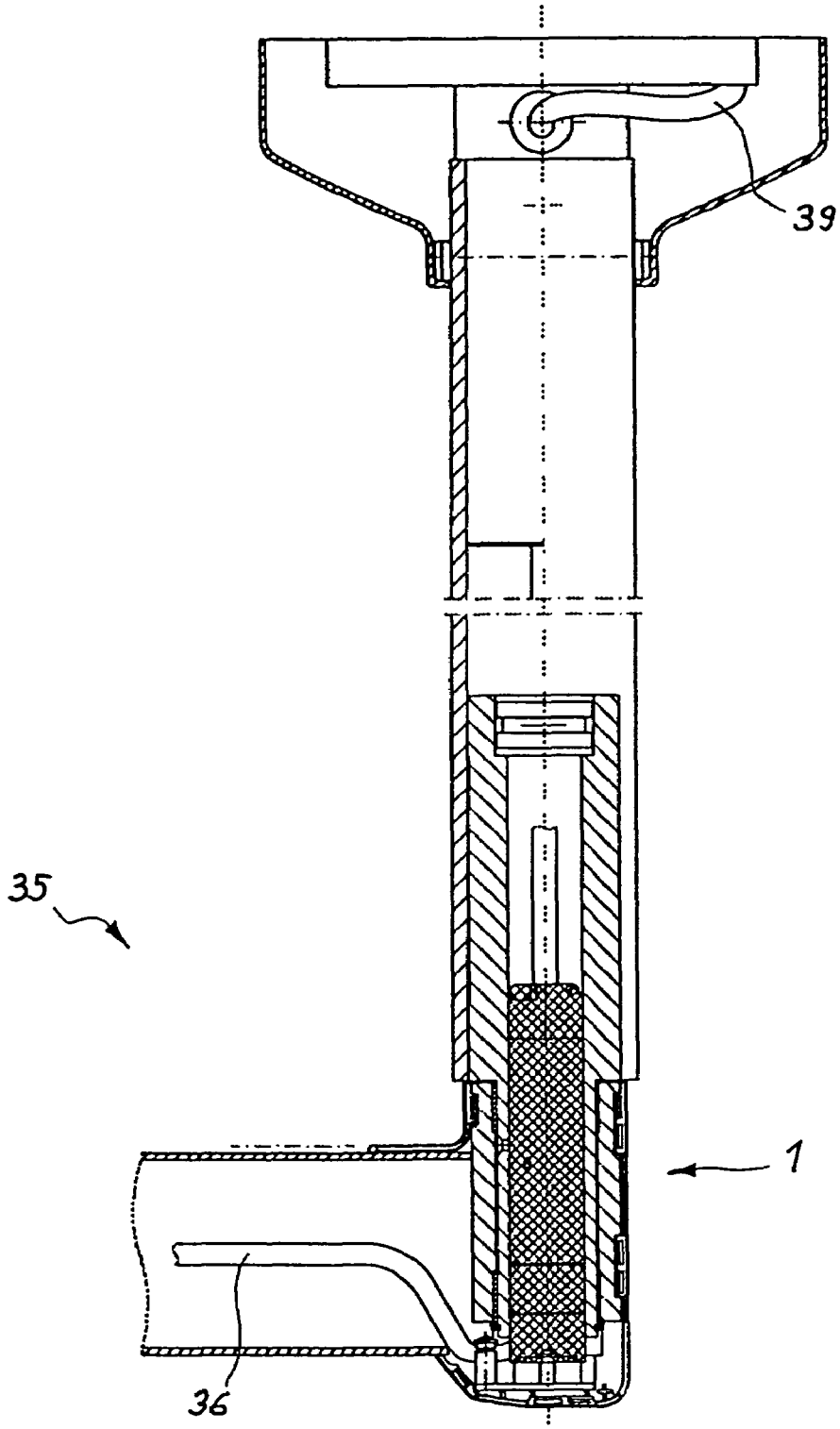
FIG. 19, in a sectional side view, a support for a ceiling mounting.

FIG. 19 shows a support 35 for a ceiling mounting, as a variant of the wall mounting of FIG. 14.

Figure 22:
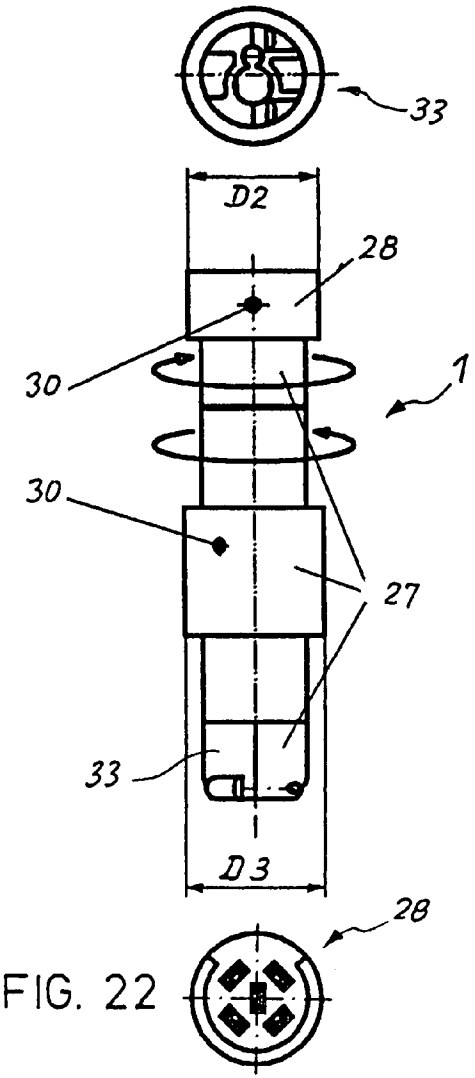
FIG. 22, in various views, a third variant of a swivel coupling.
Figure 21:
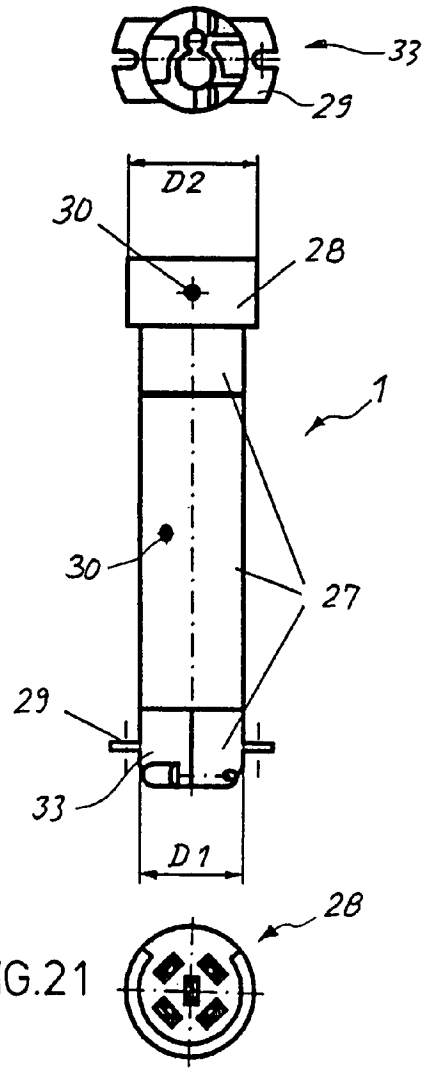
FIG. 21, in various views, a second variant of a swivel coupling.
Figure 20:
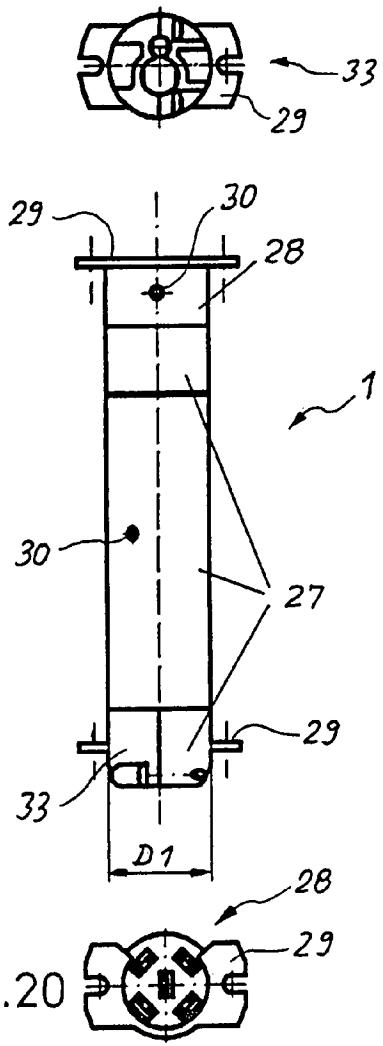
FIG. 20, in various views, a first variant of a swivel coupling.

In FIGS. 20 through 22, three variants of swivel couplings 1 are shown, which differ essentially from one another in their outer geometry and the resultant fastening or mounting options. The coupling 1 can thus be adapted to various installation conditions.

Variant 1 (FIG. 20)

Axial fastening of plug coupling 27 and plug connection 28 by means of tabs 29, installed for instance in a tube with an inside diameter D1 of 24 mm.

Variant 2 (FIG. 21)

Axial fastening of the plug coupling 27 by means of tabs 29 and a radial fastening of the plug connection 28 by means of a threaded bore 30, for instance by installing the plug coupling 27 in a tube with an inside diameter D1 of 24 mm and installing the plug connection 28 in a tube with an inside diameter D2 of 31 mm.

Variant 3 (FIG. 22)

Radial fastening of the plug coupling 27 and the plug connection 28 by means of a threaded bore 30, for instance by installing the plug coupling 27 in a tube with an inside diameter D3 of 32 mm and installing the plug connection 28 in a tube with an inside diameter D2 of 31 mm.

The invention has the following advantages, in particular:

- Solidly cast rotor 16, in which the wiper rings 4 and the outward-leading lugs 7 are made in one piece.
- The wiper rings 4 are tapped with the aid of closed spring means 5 located on the outside, with specially shaped spring contacts 10, secured on one side to the spring ring 5, and are made in one piece with the second lug 8.
- Minimized structural length, while maintaining all the installation thicknesses and air and creepage paths required by the VDE, for a power of 230V/16 A to be transmitted in the power portion and a power of 24V/2 A in the signal portion, including protective conductors.
- Minimized diameter (24 mm), while maintaining all the installation thicknesses and air and creepage paths required by the VDE, for a power of 230V/16 A to be transmitted in the power portion and a power of 24V/2 A in the signal portion, including protective conductors.
- Five current paths of equal rank, for instance for selective operation of ohmic and inductive loads, as well as video signals.
- Capability of securing the coupling 1, 1.1 and connecting the protective conductor SL to the housing 22 by means of a radial screw fastening.
- Integrated plug connection 28 for disconnecting the electrical connection.

List of Reference Numerals:

1, 1.1 Swivel coupling
2, 3 Wiper contact ring arrangement
4 First wiper ring
5 Second wiper ring
6 Direction
7 First lug
8 Second lug
9 Direction
10 Spring contact
11 Groove connection
12 End region
13 Contact tongue
14 Plug connection
15 Soldered connection
16 Rotor
17 Plastic
18 Wiper ring surface
19 Sleeve
20, 21 Half-shell
22 Housing
23 Detent protrusion
24 Swivel joint
25 Tripod
26 Notch
27 Plug coupling
28 Plug connection
29 Tab
30 Threaded bore
31 Plastic disk
32 Plastic disk
33 Tension relief
34 Groove connection
35 Support
36 First cable
37 Second cable
38 Third cable
39 Fourth cable
40 Electrical appliance
41 U-shaped recess
42 Weakening recess
43 Deformation
2L1, 2L2 Signal lines
SL Protective conductor
N, L Power line
D1, D2, D3 Diameter

What is claimed:

1. An electrical swivel coupling comprising an inner wiper contact ring arrangement (2) and an outer wiper ring arrangement (3) for transmitting electrical current;

wherein said inner wiper contact ring arrangement (2) comprises a plurality of first wiper rings (a), which have respective first lugs (7) leading outward to one side in an axial direction (6);

wherein said outer wiper contact ring arrangement (3) comprises a plurality of second wiper rings (5), which have respective second lugs (8) leading outward to an opposite side in another axial direction (9) opposite from said axial direction (6), said second wiper rings (5) being provided with a plurality of spring contacts (10) formed by recesses and deformations provided in said second wiper rings (5), so that said spring contacts of said second wiper rings (5) are in electrical contact with an outer wiper ring surface (18) of said first wiper rings (4) arranged coaxially in relation to said second wiper rings;

wherein each of said first wiper rings (4) is in one piece with an associated one of said first lugs (7) connected therewith and each of said second wiper rings is in one piece with an associated one of said second lugs (8) connected therewith;

wherein each of the first wiper rings and the associated one of the first lugs together have a T-shape and each of the second wiper rings and the associated one of the second lugs together have a T-shape in respective developed forms prior to connecting opposite ends of wiper surfaces of said wiper rings to form said wiper rings; and wherein the first wiper rings and the second wiper rings have corresponding tongue-and-groove connections (11) connecting the opposite ends of said respective wiper ring surfaces.

2. The electrical swivel coupling as defined in claim 1, wherein each of the first lugs (7) or the second lugs (8) has an end region (12) and said end region (12) is a contact tongue (13) of a plug connection (14) or is a soldered connection (15).

3. The electrical swivel coupling as defined in claim 1, further comprising a cast plastic rotor (16), and wherein said plastic rotor (16) is cast with said first wiper rings (4) and said first lugs (7) and said outer wiper ring surfaces (18) and said end regions (12) of the first lugs (7) are exposed or not covered with plastic (17) of said plastic rotor (16).

4. The electrical swivel coupling as defined in claim 1, further comprising a plastic sleeve (19), and wherein said second wiper rings (5) with the second lugs (8) are received by said plastic sleeve (19).

5. The electrical swivel coupling as defined in claim 4, wherein said plastic sleeve (19) comprises two identical half-shells (20, 21) that are fixed to each other.

6. The electrical swivel coupling as defined in claim 4, further comprising a housing (22) that is securable from an exterior thereof and wherein said plastic sleeve (19) is received by said housing (22).

7. The electrical swivel coupling as defined in claim 3, further comprising a plastic sleeve (19), and wherein said second wiper rings (5) with the second lugs (8) are received by said plastic sleeve (19), said plastic rotor (16) is provided with detent protrusions (23) on an opposite end from said first lugs (7), and said detent protrusions (23) engage with said plastic sleeve (19), so that axial displacement of said plastic rotator (16) from said plastic sleeve (19) is prevented.

8. The electrical swivel coupling as defined in claim 3, wherein the plastic rotor (16) is provided with a plug connection (14).

9. The electrical swivel coupling as defined in claim 1, wherein the first wiper rings (4) and the second wiper rings (5) are selectively provided with means for driving ohmic loads, inductive loads and video signals.

10. The electrical swivel coupling as defined in claim 1, formed for a swivel joint (24) of a tripod (25).

* * * * *